United States Patent [19]

Geberth, Jr.

[11] Patent Number: 4,768,932

[45] Date of Patent: Sep. 6, 1988

[54] HYDRAULIC PAINT PUMP

[76] Inventor: John D. Geberth, Jr., 10 Goose Cove La., Ramsey, N.J. 07446

[21] Appl. No.: 890,752

[22] Filed: Jul. 25, 1986

[51] Int. Cl.[4] ..... F04B 21/02

[52] U.S. Cl. ..... 417/552; 137/71; 137/533.17; 417/570; 417/388

[58] Field of Search ..... 417/388, 552, 559, 569, 417/570; 137/71, 533.17, 543.21

[56] References Cited

U.S. PATENT DOCUMENTS

| | | | |
|---|---|---|---|
| 1,483,436 | 2/1924 | Hazard | 137/533.17 |
| 1,693,114 | 11/1928 | Heany | 137/533.17 |
| 1,788,886 | 1/1931 | Nutt | 417/388 |
| 2,430,427 | 11/1947 | Katcher | 137/543.21 |
| 2,554,002 | 5/1951 | Beamesderfer et al. | 137/533.17 |
| 2,585,773 | 2/1952 | Hartman | 137/543.21 |
| 2,843,044 | 7/1958 | Mashinter | 417/559 |
| 3,693,644 | 9/1972 | Dilorenzo | 137/71 |
| 4,035,107 | 7/1977 | Kesten et al. | 417/310 |
| 4,679,989 | 7/1987 | Harriman et al. | 417/552 |

FOREIGN PATENT DOCUMENTS

| | | | |
|---|---|---|---|
| 2037947 | 7/1980 | United Kingdom | 417/569 |

*Primary Examiner*—Leonard E. Smith

*Attorney, Agent, or Firm*—Collard, Roe & Galgano

[57] ABSTRACT

There is provided an improved airless paint spray pump having an intake, an inlet valve assembly, a pumping chamber, an outlet, an outlet valve assembly, and stroke pumping means for pumping the fluid paint into the pumping chamber through the intake during the intake stroke and through the outlet on the pumping stroke. The inlet valve assembly includes a flat valve which cooperates with a valve seat at the intake and is displaced from the valve seat during the intake stroke of the pumping means and is seated on the valve seat during the pumping stroke of the pumping means. The flat inlet valve replaces the previous ball type inlet or check valve thereby expanding the design capabilities of the pump.

14 Claims, 5 Drawing Sheets

HYDRAULIC PAINT PUMP

The present invention relates generally to hydraulic paint pumps which pump liquid paint to such a pressure that, upon release of the pressurized paint from a spray opening or nozzle in a spray gun, the paint is thereby atomized and rendered suitable for spray painting. More particularly, the present invention relates to improvements in hydraulic paint pumps wherein the type of valves utilized in the pumps permits the pumps to be more easily self primed, pump heavier materials and result in substantially longer pump life.

One of the systems for painting utilized today, particularly for industrial work, is hydraulic or airless paint spraying wherein the paint is supplied to a spray gun which may or may not be hand held and, because of the very high pressure at which the paint is supplied to the spray gun, the paint is caused to be atomized into a fine spray suitable for painting upon exiting the spray nozzle. Such a painting method is far more efficient than paint spraying by means of pressurized air and painting by hand. Spray painting by means of pressurized air results in a great deal of material waste because of overspray. With respect to hand painting methods utilizing brushes and rollers, the manpower requirements render this method very uneconomical. In hydraulic or airless paint spraying, several types of high pressure pumps are available for creating the high hydraulic pressures required for the atomization of the liquid paint. The different types of pumps which are utilized are double acting piston pumps, single acting piston pumps and diaphragm type pumps.

In the double acting type piston pump, a stepped piston reciprocates in a cylinder having an inlet at the cylinder head and an outlet at the far end of the cylinder. Two chambers are formed in the cylinder by the stepped piston, both chambers together can be considered the pumping chamber with the first or inlet chamber being defined by the piston head and the cylinder and the outlet or exhaust chamber, which is approximately one-half the volume of the intake chamber, is formed at the opposite end of the piston and is defined by the stepped down portion of the piston and the cylinder wall. The piston is sealed at its exit from the cylinder thereby further defining the chamber. A transfer valve is disposed between the two chambers and is adapted to close during the intake stroke of the piston while simultaneously the inlet valve is opened by vacuum so as to draw material into the inlet chamber. On the down stroke or exhaust stroke of the piston, the inlet valve is closed by the pressure exerted on it while the bypass valve is opened by the pressure on it so as to permit the material in the inlet chamber to pass through the transfer valve and into the exhaust chamber. Because of the volume difference between the inlet and exhaust chambers, half the material is forced into the pump outlet during this stroke while the other half remains in the exhaust chamber. On the next intake stroke, as the piston withdraws, it forces the remaining material in the exhaust chamber into the pump outlet while, at the same time, material is being brought in through the inlet valve into the intake chamber. Heretofore, ball valves have been utilized for both the intake and transfer valves of such pumps. Examples of double acting pumps can be found in U.S. Pat. No. 4,086,936, to Vork, granted May 2, 1978 and in U.S. Pat. No. 3,330,217, to Baur et al., granted July 20, 1965, the disclosures of which are herein incorporated by reference.

In the operation of the single acting piston pump, the transfer valve of the double acting piston is eliminated and there is no exhaust chamber provided so that, upon the intake stroke, material is drawn in through the inlet valve into the intake chamber and, upon the following down stroke, a check or outlet valve is opened to permit the material to be forced therethrough by the movement of the piston. On the intake stroke, the check valve is maintained in a closed position by the pressure at the pump outlet. As in the case of the double acting pumps, ball type valves are utilized for both inlet and outlet valves of single acting pumps. In the diaphragm pump, whose operation is similar to that of the single acting piston pump, the inlet valve is in the form of a poppet valve having a conically shaped valve seat which is spring biased to the closed position. Thus, as the diaphragm operates on the intake stroke, the vacuum created causes a differential pressure which overcomes the bias of the spring and the weight of the valve to lift the valve off its seat and cause material to enter the pumping chamber. On the exhaust stroke, the spring biased valve is closed and a check or outlet valve is opened by the pressure exerted by the diaphragm to permit the material in the pump chamber to be exhausted to the outlet of the pump. An example of a diaphragm pump can be found in U.S. Pat. No. 3,680,981, to Wagner, granted Aug. 1, 1972, the disclosure of which is herein incorporated by reference.

With respect to piston pumps which utilize ball type valves, a number of shortcomings exist which can be attributed directly to the use of the ball type valve itself. First, concerning design limitations, there is a definite limitation on the size of the valve opening which can be provided since as the diameter of the opening increases, the diameter of the ball likewise increases. However, while the area of the valve opening is proportional to the square of its diameter, the volume of the ball, which determines its weight, is proportional to the cube of the diameter so that there is a disproportionate increase in the weight of the ball as the area of the inlet opening is increased. An increase in the weight of the ball requires a greater differential pressure by the pump to lift the ball off its seat and, thus, a disproportionate increase in the required differential pressure results when the inlet opening is enlarged. At the same time, because of the use of a ball type valve, the differential pressure itself is limited by the compression ratio of the piston which in turn is restricted because of the presence of the ball in the pumping chamber. Thus, again, the diameter of the ball of a ball type valve comes into play. These factors have an effect on the ability of the pump to self prime in that, because of the relatively low differential pressures that are produced, such pressure may not be sufficient to overcome both the weight of the ball and the adhesion of the ball to the valve seat as a result of dried paint. Another resulting problem is the inability of the pump to operate properly with heavy materials where the differential pressure may be insufficient to draw the material into the pump, thus resulting in cavitation. Thus, it can be appreciated that the design parameters of such pumps are severely limited because of the use of ball-type valves.

Leakage and premature wearing out of the valves in such pumps is also a problem. When the ball valve closes in a pump which is pumping material for atomization and painting, particles of paint are caught between the ball and its seat, which is usually a 45° conical seat. These particles are generally crushed between the ball and its seat and cause no problems. However, a few particles fail to be crushed because of the low pressure exerted on the particles on account of the relatively large contact area between the ball and its seat and cause a build-up of material between the ball and its seat. This build-up of material at the valve seat eventually results in leakage past the seat which in turn results in erosion of the ball. Thus, the seal is destroyed and no pressure is produced by the pump. Another problem with the ball type valve is that, as it is closing, the ball tends to bounce around on its seat before finally closing and sealing thereagainst, which results in less efficiency and eventual leakage because of resulting seat wear. With respect to diaphragm pumps, these operate at speeds of 1800 cycles per minute as opposed to approximately 300 for a piston type pump. Because of such high operating speeds, the inertia effects of the valve and its stem are a limiting consideration for this type of pump. Furthermore, the conically shaped seat of the poppet valve utilized in the diaphragm type pump results in a large contact area which can lead to leakage as described above. Also, the inclined surfaces of the valve and its seat must be machined and polished very carefully to insure proper operation. This machining and polishing is an expensive operation. Such diaphragm type pumps are also very difficult to self prime since the valve guide and valve stem of the inlet valve form a large surface area for dried paint to adhere to and which must be overcome on pump startup. The force of the valve closing spring must also be overcome. Also, during operation, pipe friction is an important limiting factor since the material must flow around the closing spring, the guide and the valve stem.

Thus, it can be seen that there are two separate operating considerations for such pumps, startup or self priming and running. The factors which affect startup are the compression ratio, valve weight, valve opening area and seating surface. With respect to the running condition of such pumps, the valve opening area is an important factor as well as the size of the contact surface of the valve seat. As noted above, the compression ratio determines the differential pressure produced by the pump which must overcome the weight of the valve, the adherence of the valve to its seat and the pipe friction of the material through the valve opening. Optimally, a pump design should provide a large differential pressure, a light weight valve, a large valve opening area (to reduce pipe friction) and a small valve contact area.

It is, therefore, a primary object of the present invention to improve pumps used for the hydraulic atomization and spraying of paint by providing a large differential pressure, a light weight valve, a large valve opening area and a small valve contact area so that such pumps are more effective than heretofore, have a longer operating life than heretofore and are capable of handling a wide range of paint thicknesses.

The above object, as well as others which will hereinafter become apparent, is accomplished in accordance with the present invention by the use of flat valves in double acting and single acting piston pumps and diaphragm type pumps used in the hydraulic atomization and spraying of paint. In the double acting piston pump, flat valves are utilized both for the intake valve as well as the transfer valve of the pump and, in the single acting pump, a flat valve is used for the inlet valve thereof. The use of a flat valve for the inlet valve of the piston pump permits a much higher compression ratio than a comparable ball valve since the flat valve is very thin relative to the ball for the same size valve opening. The resulting increased differential pressure created by the piston results in a far greater force which can be brought to bear to lift the valve off its seat to overcome the weight of the valve and the adhesion of the valve to its seat because of dried paint thereat. Furthermore, the weight of a flat valve is much less than that of a comparable ball valve for the same size inlet opening. The valve opening area can also be increased substantially since the increased weight of the flat valve is proportional to the square of its diameter rather than to the cube of its diameter as in the case of a ball valve. The benefits derived from this valve construction are a greatly increased ability for the pump to prime itself on initial startup and the ability to handle much heavier materials. Another beneficial aspect is that this valve design permits the use of tungsten carbide for the valve and its seat since the weight of the valve is far less critical. The use of tungsten carbide material results in far less wear of the valve and thus a substantial increase in the useful life of the pump and also permits of a very narrow valve seat contact area. Still another beneficial result of the use of such a valve is that the area of contact between the valve and its seat is greatly reduced as compared to a ball type valve so that particles of paint which come between the two contact surfaces are more effectively crushed, thereby substantially eliminating the material build-up and resulting wear which inadequately crushed paint material can cause.

The use of such a flat valve as the intake valve to replace the poppet valve in a diaphragm pump significantly contributes to the efficiency of such a pump in that the inertia of the valve is substantially reduced by the elimination of the valve stem. Also, the pipe friction is significantly reduced by the elimination of the valve guide, valve stem and closing spring. In addition, since the closing spring is eliminated, there is no closing spring force for the differential pressure to overcome. Also, the surface for dried paint to adhere to is significantly reduced.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
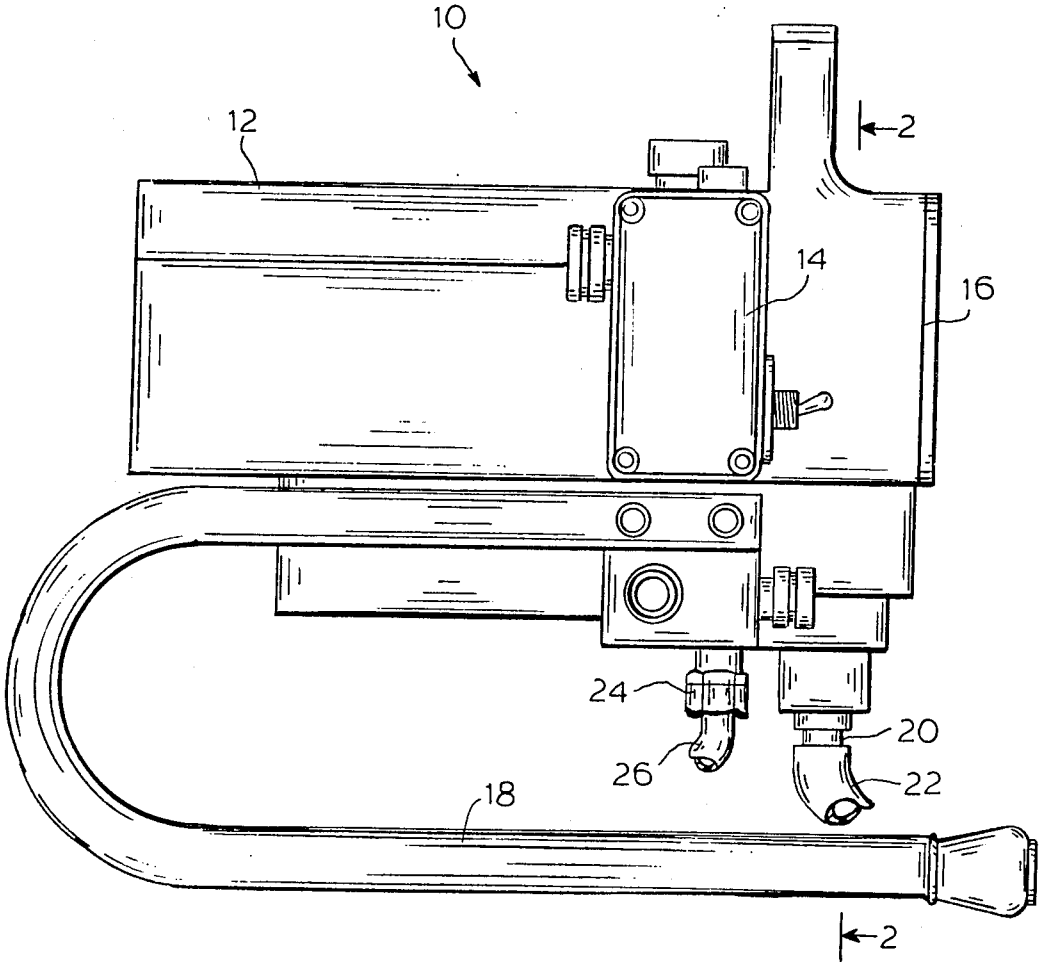
FIG. 1 is a side elevational view of a pumping system incorporating an improved hydraulic paint pump according to the present invention.
Figure 2:
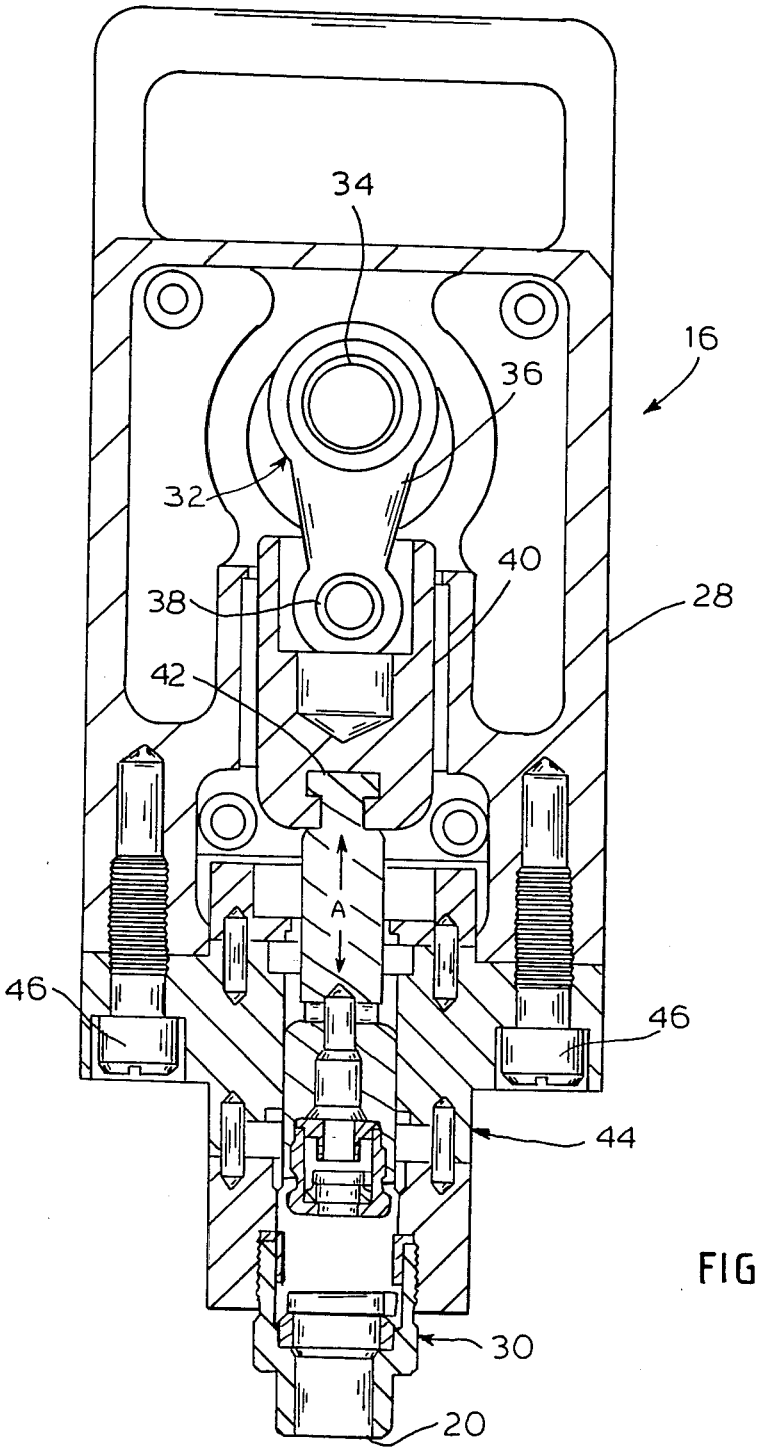
FIG. 2 is a cross-sectional view of the pump system of FIG. 1 taken along the line 2—2 of FIG. 1 showing the double acting pump utilized therein.

Now turning to the drawings, there is shown in FIG. 1 a pumping system, generally designated 10, including a motor section 12, a motor control 14, a pump section 16 and support legs 18. Motor section 12 houses an electrical motor (not shown) which drives pump section 16. The inlet 20 of pump section 16 is connected by means of flexible hose 22 to a source of liquid such as coating material which is to be pumped to a sufficiently high pressure to permit atomization of the material for spray painting purposes. The outlet of pump section 16, designated 24, is connected to a flexible hose 26 which in turn is connected to a spray device such as a spray gun (not shown) which is adapted to hydraulically atomize and spray the high pressure liquid material. As clearly seen in FIG. 2, pump section 16 is comprised of a housing 28, which forms part of the pump system body, reciprocating pump 30 and pump drive mechanism 32. Pump drive mechanism 32 includes crank 34 which is driven by the motor of motor section 12, connecting rod 36 and connecting pin 38 which transform the circular motion of crank 34 into a reciprocating motion at connecting pin 38 which connects slider mechanism 40 to connecting rod 36. Slider mechanism 40 in turn is connected to piston 42 of reciprocating pump 30 and imparts thereto a reciprocating motion in the direction of arrow A. Reciprocating pump 30, which is a double acting pump, is housed within pump body 44 which in turn is securely fastened to housing 28 by means of securing screws 46.

Figure 3:
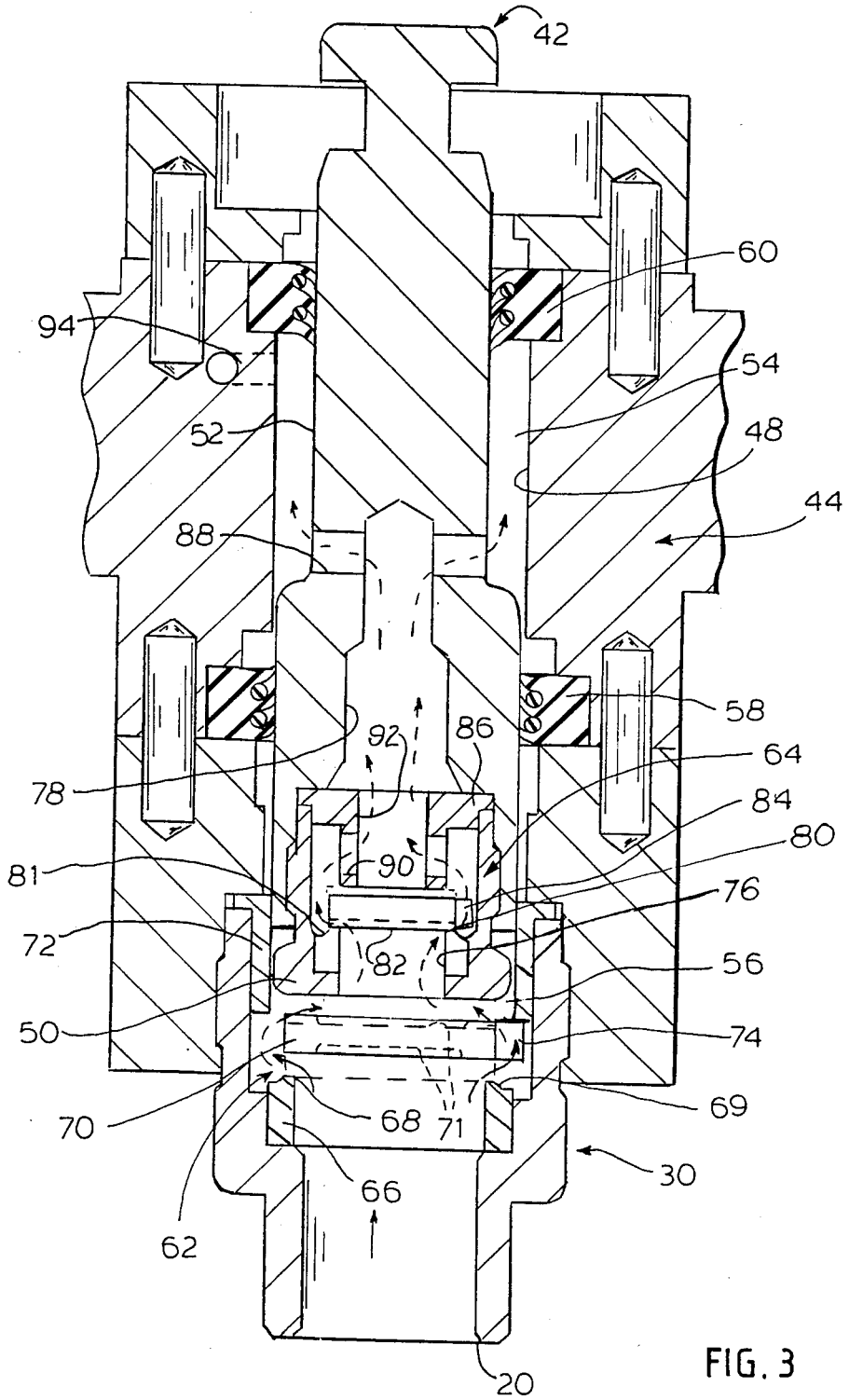
FIG. 3 is a cross-sectional view of the double acting pump incorporating the improvement of the present invention as utilized in the pumping system of FIG. 1.

As clearly seen in FIG. 3, reciprocating pump 30, in conjunction with pump body 44, pumps the coating material from the source thereof through hose 22 and into inlet 20 to the high pressure required for atomization of the coating material and supplies the same to outlet 24 from which it is delivered to the spray device by means of hose 26. Thus, a cylinder 48 is provided in pump body 44 within which piston 42 reciprocates. The head 50 of piston 42 is sized to fit within cylinder 48 and define therewith intake chamber 56 while the base part 52 of piston 42 is stepped down to a diameter less than that of piston head 50 or cylinder 48 and defines with the cylinder outlet or exhaust chamber 54. Chambers 54 and 56 taken together can be considered a pumping chamber since pumping occurs in both chambers from the reciprocal movement of piston 42. Outlet chamber 54 and intake chamber 56 are sealed from one another by means of packing seal 58 in cylinder 48 which seals against piston head 50 of piston 42. An additional packing seal 60 seals around base part 52 of piston 42 at pumping chamber 54. The diameters of head 50 and base part 52 of piston 42 are relatively dimensioned so that intake chamber 56 is double the volume of outlet chamber 54.

An intake or foot valve assembly 62 controls the flow of coating material into intake chamber 56 from inlet 20. Transfer valve system 64 controls the flow of coating material between intake chamber 56 and outlet chamber 54. Intake valve assembly 62 comprises a valve seat insert 66 in inlet 20, having a valve seat 68 which cooperates with flat valve 70 in chamber 56. Flat valve 70 and valve seat 68 are generally circular in shape and have lapped surfaces to insure proper seating. A trough or valley 69 is formed around the periphery of seat 68 in order to catch paint material and prevent it from settling at or near seat 68 and lead to material build-up between seat 68 and the contact surface of valve 70 which can result in improper seating of the valve. Valley 69 may be formed by tapering valve insert 66 up to seat 68. During the upward stroke of piston 42, valve 70 is lifted off seat 68 by the differential pressure created by the resulting vacuum, as seen in solid lines in FIG. 3, thus allowing coating material to enter intake chamber 56 from intake 20. In order to limit the travel of flat valve 70 within chamber 56, a valve retainer, designated 72, which is formed as part of the wall of cylinder 48 in chamber 56 engages with at least three stops 74 which extend radially outwardly from valve 70. The three stops 74 extending radially from valve 70 also serve to maintain the valve centered in chamber 56 and with respect to valve seat 68.

Transfer valve system 64, which may be incorporated in piston 42, comprises a valve seat insert 76 which is inserted in transfer bore 78 of piston 42 and which is provided with a seat 80 which cooperates with flat valve 82. The contact surfaces of seat 80 and valve 82 are lapped to insure proper seating and a trough or valley 81 is formed around the periphery of seat 81 in order to prevent paint material from settling at or near seat 80. Flat valve 82 is provided with at least three radially extending stops 84 which serve to center valve 82 with respect to bore 78 and with respect to seat 80. Valve retainer 86 serves to limit the travel of flat valve 82 in bore 78. Bore 78 in piston 42 communicates with outlet chamber 54 via cross bore 88 in stepped base part 52 of piston 42. Thus, on the downward stroke of piston 42, valve 82 is lifted off its seat 80, as seen in phantom in FIG. 3, and valve 70 is forced onto its seat 68, as also seen in phantom. This opening and closing of valves 82 and 70 allows coating material in intake chamber 56 to enter transfer bore 78 in piston 42 and pass through openings 90 and 92 of valve retainer 86 and enter into outlet chamber 54 via cross bore 88. During this downward stroke of piston 42, since the volume of outlet chamber 54 is one-half that of intake chamber 56, half the material which enters chamber 54 is forced into outlet bore 94 which communicates with outlet 24 of pump section 16. Upon the next intake stroke of piston 42, the remaining material in chamber 54 is forced through outlet bore 94 simultaneously as new coating material enters intake chamber 56. For safety purposes, valve 70 is undercut at 71 radially inwardly from seat 68 so that in the event of excessive pumping pressure, this undercut will blow through thereby destroying the valve.

Flat valves 70 and 82 and their respective seats 68 and 80 are preferably formed of tungsten carbide which results in very long wear characteristics for these parts. Furthermore, it should be noted that flat valves 70 and 82 each have the same shapes and configurations on the opposite sides thereof. Thus, as one side of such a valve wears, it is possible to disassemble pump section 16 and turn the worn valve around so that a new valve face is utilized. This feature also greatly extends the useful life of the pump.

Figure 4:
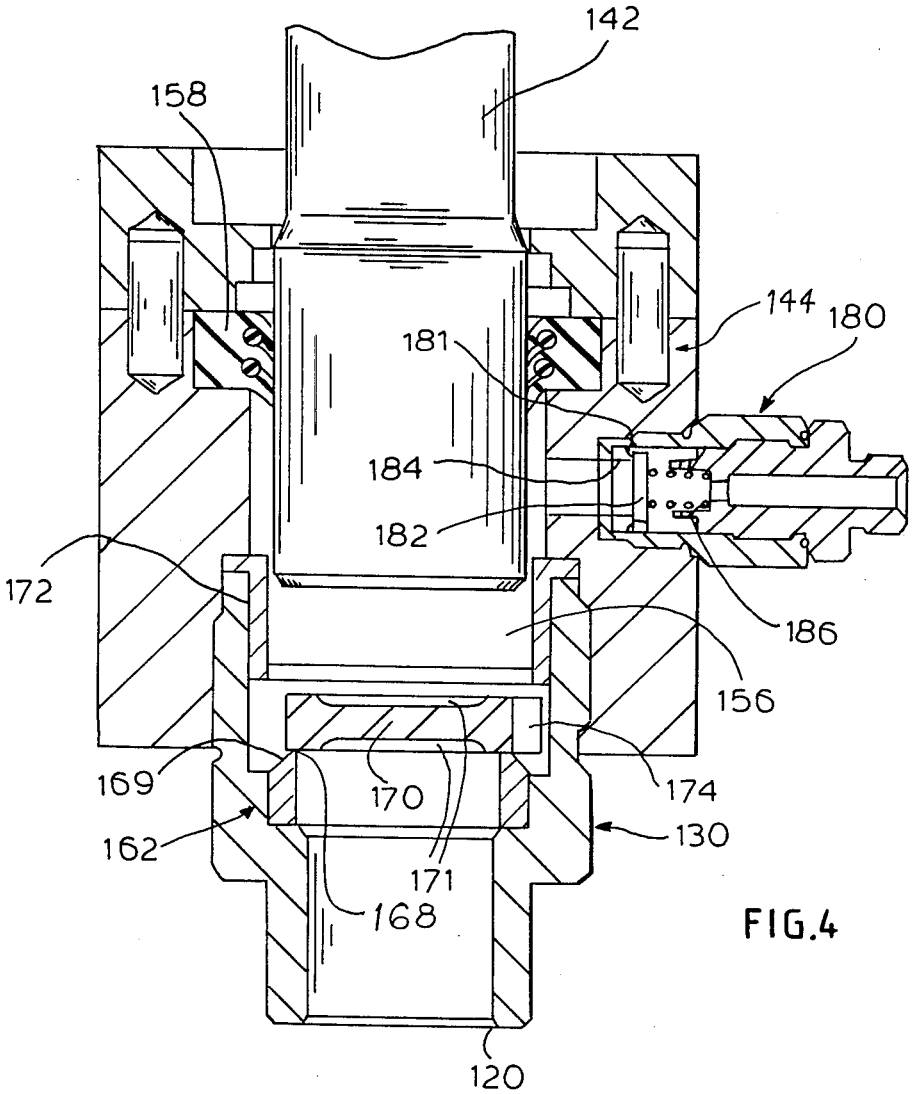
FIG. 4 is a cross-sectional view of a single acting pump incorporating the improvement according to the present invention which may be utilized in the pumping system of FIG. 1.

In FIG. 4 there is shown a single acting reciprocating pump 130 cooperating with a pump body 144 and which may be utilized in pump section 16 of pump system 10 in place of double acting reciprocating pump 30. The operation of single acting pump 130 is very similar to that of double acting pump 30 except that there is no transfer valve and no separate outlet chamber. Thus, on the intake stroke of piston 142, flat valve 170 of intake valve assembly 162 is lifted off valve seat 168 to allow coating material to enter pumping chamber 156 from inlet 120. The travel of flat valve 170 in chamber 156 is limited by valve retainer 172 which cooperates with at least three stops 174 which extend radially outwardly from valve 170. Seal packing 158 seals chamber 156 around piston 142. Upon the downward stroke of piston 142, valve 170 is forced on its seat 168 and the coating material in pumping chamber 156 is forced through outlet valve 180. Outlet valve 180, which in function is a check valve, may also be comprised of a flat valve 182 which is urged against valve seat 184 by spring 186. Thus, upon the down stroke of piston 142, the spring force of spring 186 is overcome and the fluid in chamber 156 passes through outlet valve 180 to a spray device. As in the case of the double acting pump of FIG. 3, inlet valve 170 is provided with undercuts 171 for safety reasons and the outer peripheries of valve seats 168 and 184 have a trough or valley 169 and 181.

Figure 5:
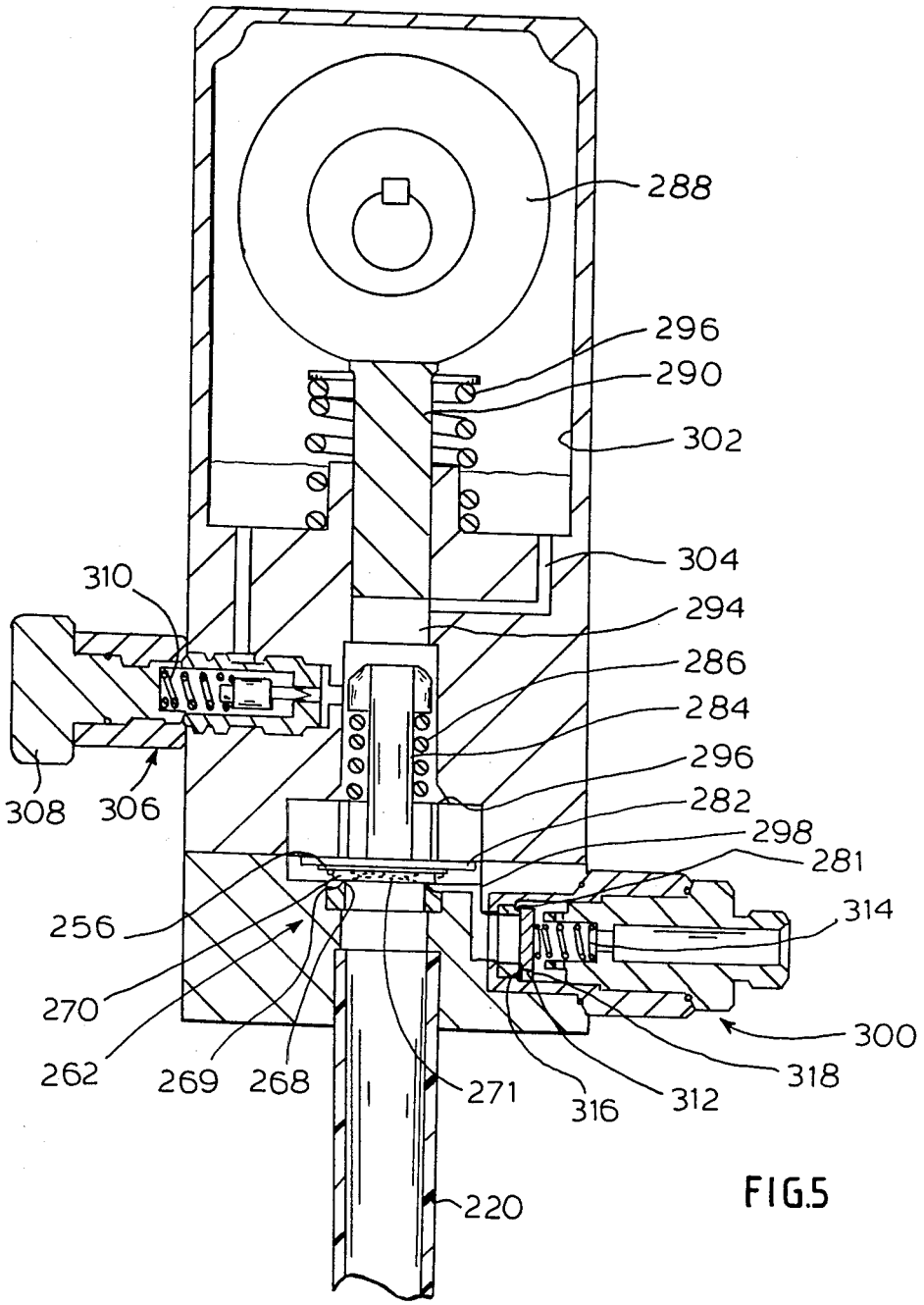
FIG. 5 is a cross-sectional view of a diaphragm type pump incorporating the improvement according to the present invention which may be utilized in the pumping system of FIG. 1.

Turning next to FIG. 5, therein is shown a diaphragm-type valve which incorporates a flat valve, as described above, which can be utilized in a system similar to pumping system 10. In this case, intake valve assembly 262 includes valve 270 which cooperates with valve seat 268. Coating material is drawn through inlet 220 and valve assembly 262 into pumping chamber 256. Chamber 256 is disposed between valve 270 and diaphragm 282. Diaphragm 282 separates pumping chamber 256 from driving fluid chamber 294 and is connected with stem 284 which is biased by spring 286 to urge diaphragm 282 upwardly in FIG. 5. On the intake stroke, spring 286 urges stem 284 along with diaphragm 282 upwardly, thereby creating a vacuum which causes a differential pressure which lifts valve 270 off seat 268 so as to permit coating fluid to enter chamber 256 through inlet 220. For the pumping operation, a cam-like crank 288 operates on follower 290 which is biased against cam 288 by means of spring 292 to force follower 290 downwardly in chamber 294 to pressurize the driving fluid therein which contacts diaphragm 282 via bores 296 to drive diaphragm 282 downwardly. This downward motion of diaphragm 282 causes flat valve 270 to seat on seat 268 so that the fluid in chamber 256 is forced through channel 298 and through outlet valve 300. A reservoir 302 for the driving fluid communicate with chamber 294 via channel 304. During the pumping stroke, channel 304 is obstructed by piston 290 during its movement in chamber 294 so that the driving fluid in chamber 294 is isolated from reservoir 302 except for transfer valve 306. Transfer valve 306 provides communication between chamber 294 and reservoir 302 and insures against a pre-set pressure in chamber 294 being exceeded. Bypass valve 306 is adjustable by means of adjustment screw 308 which adjusts the tension of spring 310 and hence the pre-set pressure for the operation of transfer valve 306. Outlet valve assembly 300 may also be comprised of a flat valve 312 which is biased by means of spring 314 against valve seat 316. Thus, the hydraulic force in chamber 294 acting on diaphragm 282 must be sufficient to overcome the bias of springs 286 and 314. As in the cas of the single and double acting pumps of FIGS. 3 and 4, inlet valve 270 is provided with undercuts 271 for safety reasons and the outer peripheries of valve seats 268 and 316 have a trough or valley 269 and 281. Valve centering means (not shown) are also provided for valve 270 and at least three stops 318 are provided on outlet valve 312 which are similar to stops 74 in FIG. 3 for the purpose of centering valve 312.

While a few embodiments of the present invention have been shown and described, it will be obvious that many changes and modifications may be made thereunto without departing from the spirit and scope of the invention.

What is claimed is:

1. An airless paint spray pump for pumping fluid paint to be sprayed to a pressure sufficient for hydraulic atomization thereof, said pump comprising:

(a) a reciprocating piston and cylinder assembly, said piston being a stepped piston forming larger and smaller piston parts reciprocable within said cylinder and defining together therewith a first pumping chamber defined by said larger piston part and a second pumping chamber defined by said smaller piston part;

(b) a pump inlet for said fluid paint centrally disposed in said first pumping chamber;

(c) a pump outlet for said pressurized fluid paint in said second pumping chamber;

(d) an inlet valve assembly including a circular flat valve in said first pumping chamber and a valve seat therefor centrally disposed at said pump inlet, said flat valve having at least three radially outwardly extending stops which center said valve in said cylinder and with respect to said valve seat;

(e) a valve retainer formed in the wall of said cylinder in said first pumping chamber adapted to engage the radially outwardly extending stops of said flat valve so as to limit the movement thereof in said cylinder; and (f) a transfer valve assembly between said first and second pumping chambers which permits the fluid paint to be pumped from said first chamber into said second chamber.

2. The airless paint spray pump as defined in claim 1, wherein said first chamber displaces about double the volume of said second chamber.

3. The airless paint spray pump as defined in claim 1, wherein said flat valve and said valve seat of said inlet valve assembly are formed of tungsten carbide.

4. The airless paint spray pump as defined in claim 1, wherein a trough is formed on the outer periphery of said inlet valve seat so that no material build-up occurs at the inlet valve contact surface.

5. The airless paint spray pump as defined in claim 4, wherein the outer periphery of said inlet valve seat is tapered from the contact surface thereof.

6. The airless paint spray pump as defined in claim 1, wherein said flat valve of said inlet valve assembly is centrally weakened radially inwardly from the seat therefor so that excessive pressure will destroy said valve.

7. The airless paint spray pump as defined in claim 6 wherein said flat valve of said inlet valve assembly is centrally undercut radially inwardly from the seat therefor to weaken said valve thereat.

8. The airless paint spray pump as defined in claim 1, wherein said transfer valve assembly includes a valve seat and a flat valve which is displaced from said valve seat during the pumping stroke of said larger piston part and is seated thereon during the inlet stroke of said larger piston part.

9. The airless paint spray pump as defined in claim 8, wherein the flat valves and valve seats of said inlet and transfer valve assemblies are formed of tungsten carbide.

10. The airless paint spray pump as defined in claim 8, which further includes a bore in said piston communicating between said first and second chambers and wherein said transfer valve seat and said transfer flat valve are disposed in said bore.

11. The airless paint spray pump as defined in claim 10, which further includes a valve retainer in said bore to limit the movement of said transfer flat valve therein during the pumping stroke of said larger piston part.

12. The airless paint spray pump as defined in claim 11, wherein said flat valve and valve seat of said transfer valve assembly are substantially circular in shape and wherein said flat valve further includes at least three radially outwardly extending stops which center said valve in said bore and with respect to said valve seat.

13. The airless paint spray pump as defined in claim 12, wherein a trough is formed on the outer periphery of said transfer valve seat so that no material build-up occurs at the valve contact surface.

14. The airless paint spray pump as defined in claim 12, wherein the outer periphery of said transfer valve seat is tapered from the contact surface thereof.

* * * * *